US009481560B2

(12) United States Patent
Barron

(10) Patent No.: US 9,481,560 B2
(45) Date of Patent: Nov. 1, 2016

(54) TUBULAR BAG WITH METERING DEVICE

(71) Applicant: Robert Bosch GmbH, Stuttgart (DE)

(72) Inventor: Dan Barron, Schaffhausen (SE)

(73) Assignee: Robert Bosch GmbH, Stuttgart (DE)

( * ) Notice: Subject to any disclaimer, the term of this patent is extended or adjusted under 35 U.S.C. 154(b) by 140 days.

(21) Appl. No.: 14/385,728

(22) PCT Filed: Feb. 4, 2013

(86) PCT No.: PCT/EP2013/052160
§ 371 (c)(1),
(2) Date: Sep. 16, 2014

(87) PCT Pub. No.: WO2013/135434
PCT Pub. Date: Sep. 19, 2013

(65) Prior Publication Data

US 2015/0053308 A1 Feb. 26, 2015

(30) Foreign Application Priority Data

Mar. 16, 2012 (DE) ..... 10 2012 204 157

(51) Int. Cl.
*B67D 7/02* (2010.01)
*B65D 75/58* (2006.01)
(Continued)

(52) U.S. Cl.
CPC ..... *B67D 7/0288* (2013.01); *B05B 9/043* (2013.01); *B05B 9/047* (2013.01); *B05B 9/0416* (2013.01); *B65D 75/5883* (2013.01); *B67D 7/66* (2013.01);
(Continued)

(58) Field of Classification Search
CPC ..... B05B 9/043; B05B 6/047; B65D 5/748; B67D 7/0294; B01F 15/0085; B67B 7/00; B67B 7/28
USPC ..... 141/10, 114, 329, 330; 383/202
See application file for complete search history.

(56) References Cited

U.S. PATENT DOCUMENTS 3,313,237 A * 4/1967 Von Plato ..... F04B 3/00 417/471
3,927,803 A * 12/1975 Weber ..... B67B 7/26 222/91

(Continued)

FOREIGN PATENT DOCUMENTS

CH 695019 11/2005
DE 10132758 1/2002

(Continued)

OTHER PUBLICATIONS

International Search Report for Application No. PCT/EP2013/052160 dated May 6, 2013 (English Translation, 2 pages).

*Primary Examiner* — Timothy L Maust
(74) *Attorney, Agent, or Firm* — Michael Best & Friedrich LLP

(57) ABSTRACT

The device (1) consists of a second connection piece (4), which can be welded via its flange (41) onto an aseptically closed tubular bag (2). A first connection piece (33) can be screwed into the second connection piece (4) and is provided at the end with opening means (34). The first connection piece (33) forms the intake piece of a metering pump (3). Securing means (5) hold the metering pump (3) in the correct position relative to the second connection piece (4) before the first use, and further means hold the metering pump (3) in the correct position relative to the second connection piece (4) in the use position.

18 Claims, 4 Drawing Sheets

(51) Int. Cl.

| | |
|---|---|
| ***B05B 9/04*** | (2006.01) |
| ***B05B 9/043*** | (2006.01) |
| ***B05B 9/047*** | (2006.01) |
| ***B67D 7/66*** | (2010.01) |
| *B65D 5/74* | (2006.01) |

(52) U.S. Cl.
CPC ..... *B65D 5/748* (2013.01); *B65D 2575/586* (2013.01)

(56) References Cited

U.S. PATENT DOCUMENTS

| | | | | |
|---|---|---|---|---|
| 5,002,202 | A * | 3/1991 | Karpisek | B67B 7/26 222/83 |
| 5,141,133 | A * | 8/1992 | Ninomiya | B65D 5/748 222/541.2 |
| 5,743,313 | A * | 4/1998 | Josefsson | B65B 69/0075 141/114 |
| 6,273,307 | B1 | 8/2001 | Gross et al. | |
| 6,343,724 | B1 * | 2/2002 | Ophardt | A47K 5/1202 137/543.23 |
| 7,926,682 | B2 * | 4/2011 | Nelson | B01F 15/0205 141/330 |
| 8,146,780 | B2 * | 4/2012 | Compton | B67D 7/0205 222/105 |
| 8,201,586 | B2 * | 6/2012 | Yoshida | B29C 73/166 141/105 |
| 8,206,034 | B2 * | 6/2012 | Keen | B65D 51/226 222/91 |
| 2008/0073348 | A1 | 3/2008 | Pritikin et al. | |

FOREIGN PATENT DOCUMENTS

| | | |
|---|---|---|
| EP | 1228972 | 8/2002 |
| EP | 1533240 | 5/2005 |
| EP | 1795456 | 6/2007 |
| JP | 7040982 | 2/1995 |
| WO | 9900308 | 1/1999 |
| WO | 2004083055 | 9/2004 |

* cited by examiner

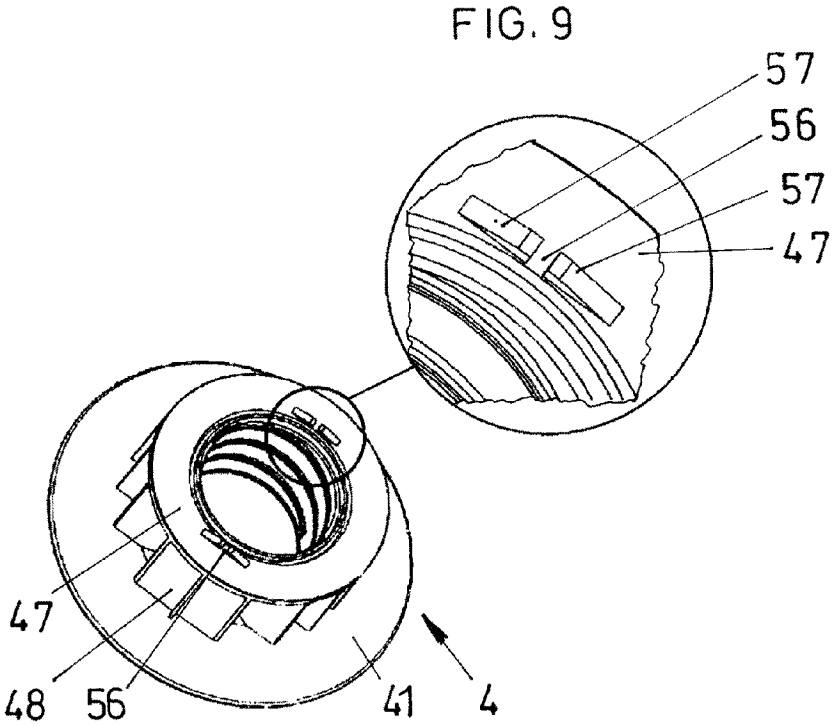
FIG. 9
FIG. 8
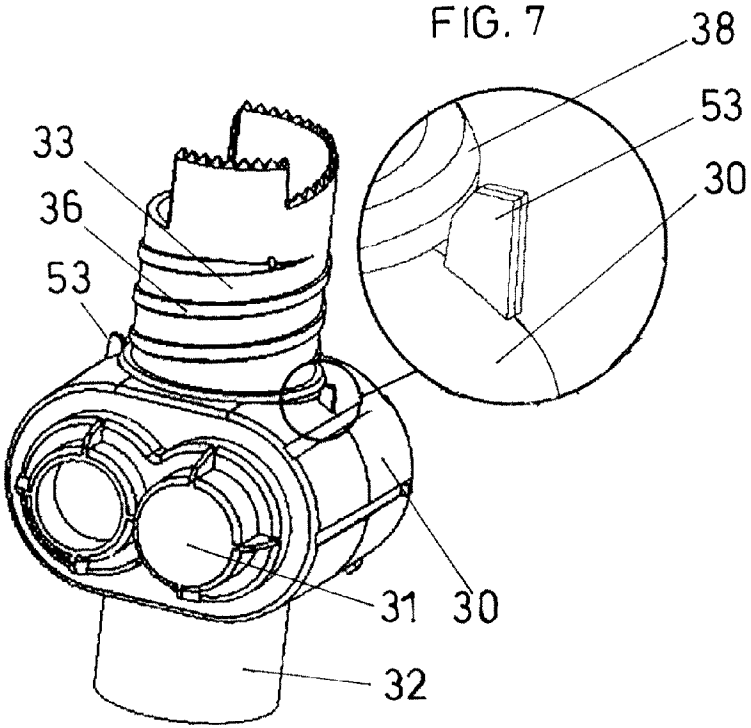
FIG. 7
FIG. 6

FIG. 10
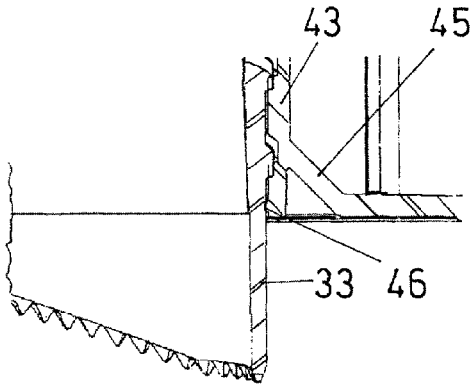
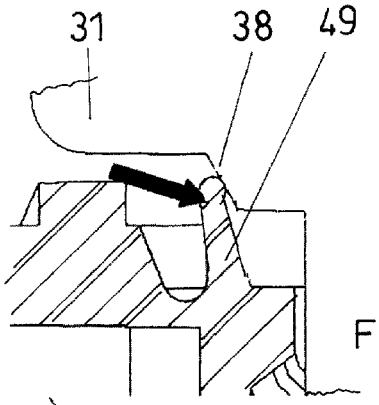
FIG. 12B
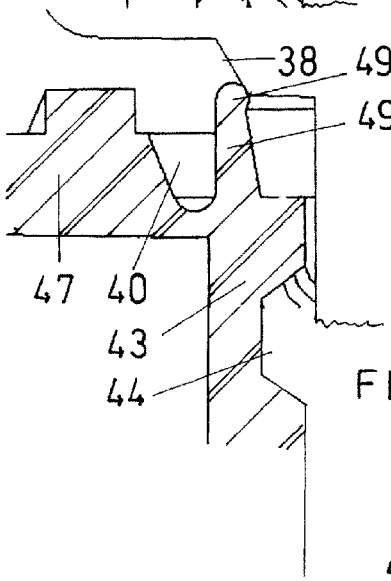
FIG. 12A
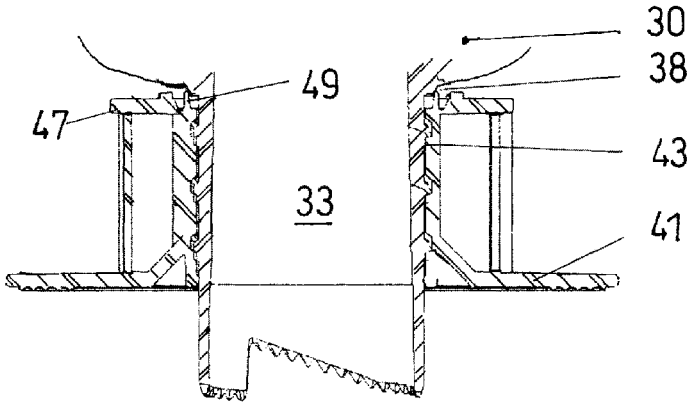
FIG. 11

TUBULAR BAG WITH METERING DEVICE

BACKGROUND OF THE INVENTION

The present invention relates to a device for the metered dispensing of a fluid from a tubular bag.

Tubular bags are to be understood here as bags which are produced from plastic film and are completely sealed. Such tubular bags are manufactured by machine by means of a corresponding folding of a plastic film, whereupon said bags are completely sealed by means of corresponding welding seams. Such tubular bags then have opening devices which consist substantially of a connection piece comprising a peripheral flange. The flange is welded onto the bag. A cutting element is held in the connection piece so as to be movable in a screwing fashion and can be actuated by means of a screw cap; thus enabling the cutting element, during the initial opening of the screw cap, to move towards the film in a screwing motion and thereby to open the completely closed tubular bag. The advantage of such a tubular bag comprising a corresponding opening device is that the contents of the tubular bag remain completely aseptically packaged and protected until the effective moment of use. Typical examples of such opening devices are known, by way of example, from the Japanese patent application JP 7040982, the WIPO patent application WO 2004/083055 or also from the European patent application EP 1795456, the European patent application 1795456 or the Swiss patent application CH 695019. These tubular bags as well as the opening device thereof are used primarily in the food branch. These closures are particularly prevalent in the area of fruit juices, flavored milk drinks or also other beverage types.

Tubular bags comprising opening devices are, however, also known in which the opening device is designed as a simple screw closure, wherein the closure device is welded between two film edges of the container. Here there are variants in which a cutting device likewise cuts open a film of the tubular bag, as, for example, is known from the European patent application 2143658 or from variants in which the bag remains open per se but the closure has a sealing membrane that is subsequently pierced by a screw cap. Such solutions are described, for example, by the U.S. Pat. No. 6,273,307 or the American patent application US 2008/0073348. Such and similar solutions are typically known for so-called refill bags as they are used, in particular, in the field of cosmetics for liquid soaps, shower gels or hair shampoos. In the case of the refill bags, a permanent receptacle is then filled, wherein the actual closure of that receptacle is unscrewed and removed and screwed on again after the refill procedure.

In the field of gastronomy, substantially larger tubular bags are, however, provided today as refill containers. In particular at fast-food restaurants, viscous, pasty and often thixotropic food products are dispensed from larger containers and are for the most part extracted from said containers using a hand pump. These are today, in particular, large canisters or plastic containers which are provided with a simple screw closure and on which a hand-operated pump is mounted. This has a variety of disadvantages. On the one hand, such containers are seldom aseptically filled and a reusable pump has to be mounted after the initial opening which must be cleaned beforehand. There is also the disadvantage that ambient air enters into the container when removing the screw closure and mounting the corresponding pump. The contents are thus no longer aseptic. In addition, air must be allowed to flow into the container after the pump has been mounted in order to replace the product which has been pressed out; thus allowing a vacuum in the container to be prevented. Because many of such food products used in the field of gastronomy oxidize when coming in contact with the ambient air or otherwise incur damage, said products must consequently be protected from spoiling by the addition of preservatives. This practice is however becoming increasingly unacceptable to consumers.

SUMMARY OF THE INVENTION

It is now the aim of the present invention to create a device for the metered dispensing of a fluid from a tubular bag, by means of which the aforementioned problems can be prevented. This aim is met by a device of the type mentioned at the beginning of the application, which is characterized by the fact that the device is a metering pump, the intake side of which is provided with a first connection piece, which has external thread and the end of which is provided with at least one cutting or perforating tooth, and wherein the first connection piece is connected in a threaded manner in a second connection piece comprising internal thread and a flange, which is welded onto the tubular bag, such that the first connection piece cuts open the tubular bag by the metering pump being twisted relative to the second connection piece.

This aim can be simply and cost effectively implemented by the metering pump preferably being implemented as a disposable pump manufactured from plastic.

Further advantageous embodiments of the device according to the invention are presented in the dependent claims. The relevancy and mode of operation of said embodiments are made clear by the following description and the accompanying drawings.

BRIEF DESCRIPTION OF THE DRAWINGS

A preferred embodiment of the subject matter of the invention is depicted in the drawings and described below. In the drawings:

FIG. 4 shows a diametric vertical section through a second connection piece which comprises a flange and can be welded to the tubular bag, whereas

FIG. 6 shows again the rotary metering pump in isolation in a perspective view, and FIG. 7 shows a specific detail of said pump in larger scale, whereas FIG. 8 shows the second connection piece of FIG. 4 in a perspective view at an angle from above, whereas FIG. 9 shows a specific detail of said second connection piece in larger scale.

FIG. 10 shows a vertical partial section through both connection pieces in the use position, just as FIG. 11 shows the same; however, in this case, both connection pieces are shown completely while omitting the actual rotary metering pump.

FIG. 12*a* serves to clearly illustrate the seal between the first and the second connection piece in an intermediate position and FIG. 12*b* clearly illustrates said seal from FIG. 12*a* in the sealing end position.

DETAILED DESCRIPTION

Figure 2:
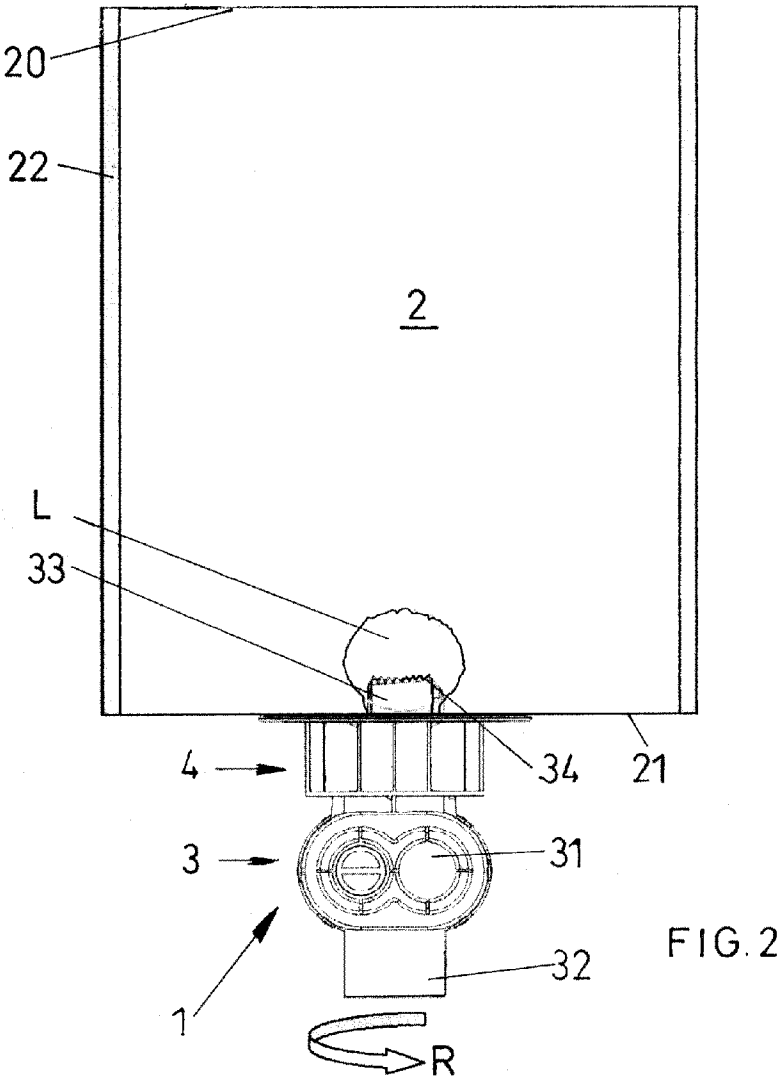
FIG. 1 shows a tubular bag comprising a device mounted thereon for the metered dispensing of a fluid in the transport position prior to the initial use and FIG. 2 shows the same tubular bag comprising the same device in the use position.

The tubular bag 6 depicted here and the arrangement of the device 1 according to the invention are shown in a schematic depiction. The tubular bag 2 has to have in this case a lower planar cover surface 21, opposite which a second cover surface or a simple folding can lie. Said folded edge is denoted with the reference numeral 20. The tubular bag is welded along the longitudinal edges and the corresponding welded edges are denoted with the reference numeral 22. In a simpler version, the tubular bag 2 would be designed in a cushion-like manner and welded along three edges. In this case, the device 1 can be mounted at any desired location on these surfaces of the tubular bag. Because the device 1 would only be visible from above and so little of the device could be seen, the symbolic configuration depicted here has been selected. The tubular bag can hereby consist either of a pure plastic film or a film that is multi-layered and has, for example, one paper or cardboard layer, one aluminum coating and respectively one plastic coating on the outer faces.

The device 1 basically consists of only two parts, namely a metering pump 3 and a connection piece 4 which is referred to below as the second connection piece. The metering pump is preferably a rotary metering pump which is evident in a side view in FIGS. 1 and 2. In this case, a pump housing 30 is seen which is covered by a bearing cover 31. The metering pump depicted here has, for example, two blade rotors which, similar to a gear pump, move in opposite directions so as to mesh with one another. In addition, an outlet piece 32 can be seen, which can be connected to a dispensing device that is not depicted here, for example via a tube which would be attached to said outlet piece. The tubular bag can, however, also be directly pendulously mounted and the outlet piece 32 can be located above that point whereat the metered dispensing of the contents takes place. In FIG. 2, a first connection piece 33 can be seen which lies opposite the outlet piece 32 and is arranged on the intake side and is therefore also referred to as the intake piece. This first connection piece 33 engages in the second connection piece 4, which has a corresponding internal thread.

Figure 1:
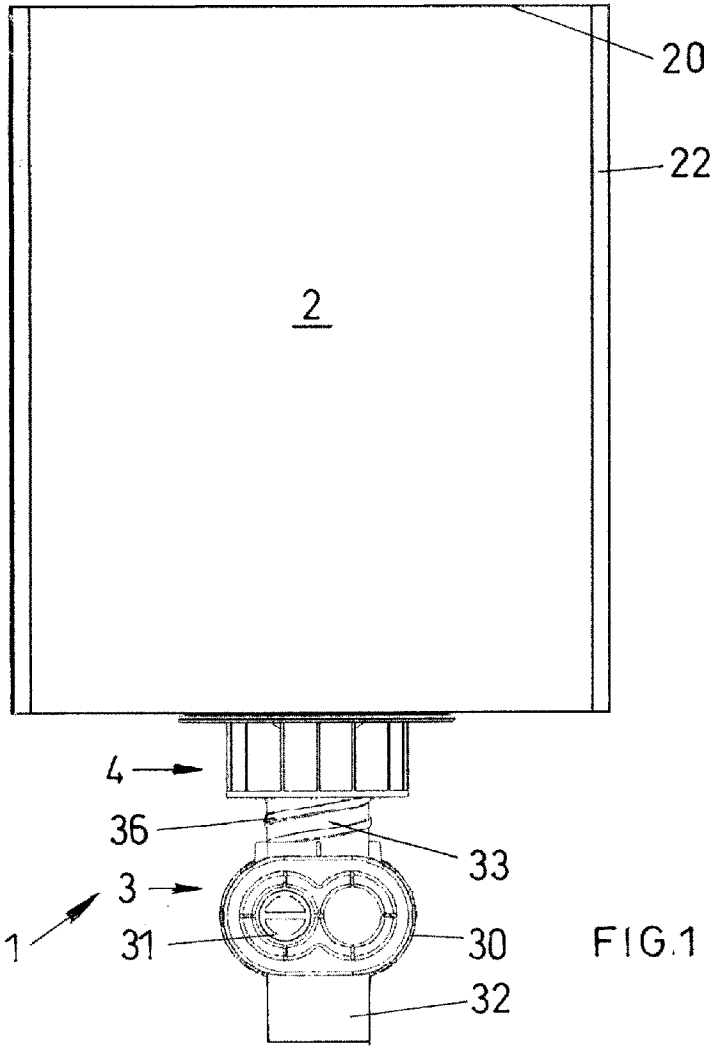

FIG. 1 shows the device 1 prior to the initial use thereof, i.e. in a storage and transport position. In FIG. 2, the same situation is depicted; however, in the use position. The arrow R indicates that the metering pump 3 has be rotated in the direction of the arrow R, and in fact in the present case about an angle of 360 degrees. As a result of this screwing motion, the thread 36 on the first connection piece 33 is now no longer visible, and the first connection piece 33 can also not be seen above the second connection piece 4. The lower end of the first connection piece 33 can however now be seen which is provided with opening means 34 at the suction-side end thereof. Said opening means 34 have now cut open the film of the tubular bag 2, and the section that has been cut open now protrudes as a round tab L into the interior of the tubular bag 2. Only now is there a continuous connection between the metering pump 3 and the interior of the tubular bag 2. In this way, a product can be aseptically filled, transported in a completely sealed manner and opened free of contamination. For logical reasons, a metering pump is additionally used which seals in each position the connection between the first connection piece 33 on the suction side and the outlet piece 32. Such a pump is preferably embodied as a disposable pump. In principle, it is, however, also conceivable to provide the tubular bag only with the second connection piece 4 while the metering pump 3 is designed as a reusable pump that remains with the user. Said pump would, however, likewise have a first, suction-side connection piece 33 comprising corresponding opening means 34. In order to operate the device, said first connection piece 33 would, of course, likewise have to have an external thread 36 which matches with an internal thread of the aforementioned second connection piece 4 which is not visible here.

Figure 3:
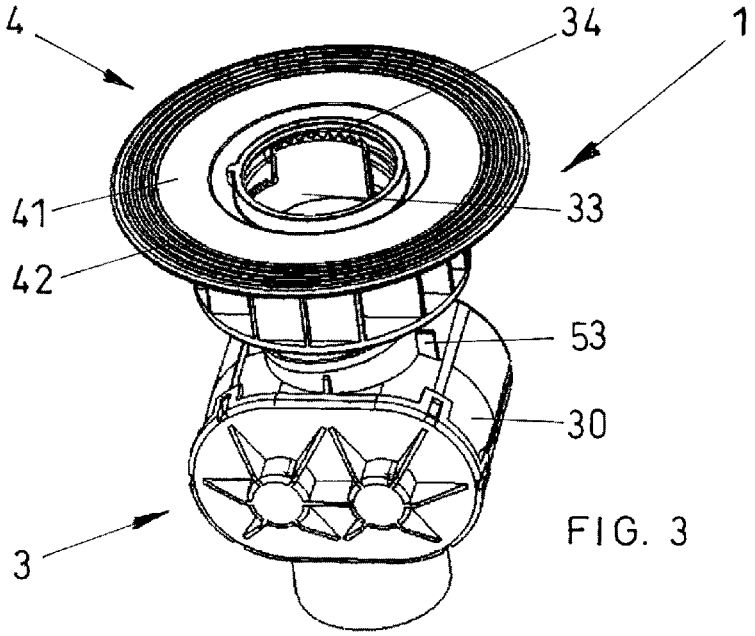
FIG. 3 shows the device embodied as a rotary metering pump in isolation prior to being mounted on a tubular bag.

The device 1 according to the invention is shown in its entirety in FIG. 3; however not in the position where said device is mounted on the tubular bag 2. In this perspective view, the second connection piece 4 is viewed from below. Said second connection piece 4 has a terminal flange 41. Said flange 41 has, for example, a plurality of circumferential energy conducting ribs 42. Said ribs serve to produce a very stable connection between the connection piece 4 and the tubular bag 2 during ultrasonic welding. The entire device 1 is also shown in FIG. 3 in the transport position. It can be seen that the first connection piece 33 comprising the opening means 34 thereof still lies completely within the second connection piece 4 and does not protrude from the same.

Figure 4:
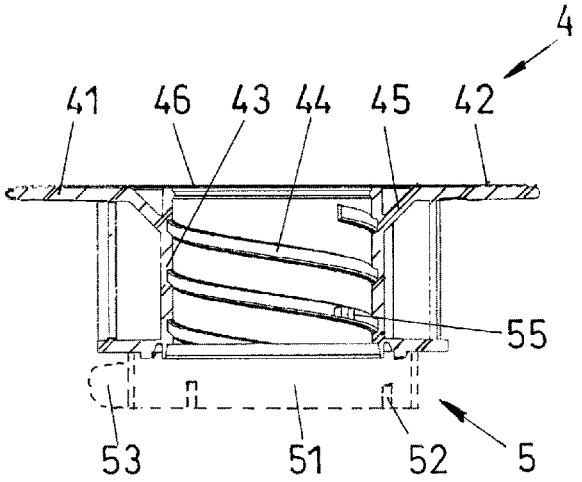
Figure 5:
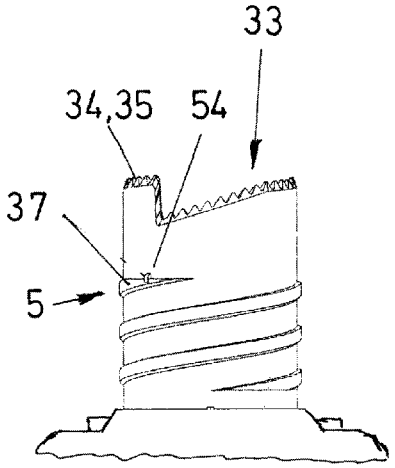
FIG. 5 shows the first connection piece which is fixedly connected to the rotary metering pump in isolation in a side view.

The second connection piece 4 is shown in isolation in FIG. 4 in a vertical diametric section. A connecting tube section 43 forms the actual connection piece and a terminal flange 41 is integrally formed thereon. The flange 41, which faces the tubular bag in the mounted state, is provided with the aforementioned energy conducting ribs 42. The connecting tube section 43 has an internal thread 44. Said internal thread is designed in such a way that it matches with the external thread 36 on the first connection piece 33. In the preferred embodiment depicted here, the terminal flange 41 is not directly connected to the connecting tube section 43, but rather the connection takes place via a connecting wall 45 that is directed conically outwards. The reason for this design is that the lower edge region of the connecting tube section 43 is to be provided with a certain amount of flexibility, because a circumferential first sealing lip or sealing bead 46 is integrally formed on the inner face in the proximity of the edge, which lies in the plane of the flange 41. This situation is again depicted in FIG. 10 in larger scale.

As can be seen in FIG. 1, the device 1 is preferably delivered to the customer or, respectively, the consumer completely assembled and mounted on the tubular bag 2. Because, as previously mentioned, the first connection piece 33 is provided with opening means 34, in particular perforating or cutting teeth 35, it must be ensured that the metering pump 3 and the first connection piece 33 that is fixedly connected thereto remain in the transport position during transport and storage and cannot unintentionally rotate relative to the second connection piece 4. Depending on the direction of rotation, the metering pump would then either detach from the second connection piece and thereby get lost or, if said pump comprising the first connection piece would twist in the opposite direction, the opening means 34 would then come in contact with the film of the tubular bag 2 and said tubular bag could possibly thereby be perforated and therefore partially opened, whereby the suitability for storage would, of course, no longer be provided. In order to implement a safeguard which prevent such an action from occurring, securing means 5 are preferably provided. Said securing means can be formed in various ways. In FIG. 4, such securing means 5 are depicted in a purely schematic manner as a dashed line and are implemented as a tamper-proof band 51, which has stop lugs 52 integrally formed on the inside thereof and is provided, for example, on the outside with an opening tab 53. Said stop lugs 52 can engage with corresponding detent ribs 53 which are directed radially outwards and are integrally formed on the pump housing 30 of the metering pump 3 at the transition of the first connection piece 33 to the housing 30, as is shown by way of example in FIG. 3.

A second embodiment of securing means 5 consists of a protrusion 54 in the entry area 37 of the first connection piece 33. This lug shaped protrusion 54 matches with a detent recess 55 in the assembled state, which recess is formed by two ramp-like protrusions in the internal thread 44 of the second connection piece 4 which extend in opposite directions. In the mounted position prior to the initial use, the first connection piece 33 is screwed into the second connection piece to such an extent that the protrusion 54 comes into engagement in the detent recess 55. In this position, the opening means 34, which preferably consist of perforating and/or cutting teeth 35, lie completely in the region of the connection tube section 43 of the second connection piece 4. It is entirely possible to combine this second form of the securing means 5 with the first version of the securing means in the form of a tamper-proof band 51.

In FIG. 6, the metering pump is depicted in isolation. The pump housing 30, the bearing cover 31 of which and the outlet piece 32 integrally formed on the pump housing as well as the first connection piece 33, which serves as an intake piece and is provided with the aforementioned external thread 36, can thus be clearly seen here. Two diametrically opposed detent ribs 53, which are depicted in a magnified view as a cut-out section in FIG. 7, can be seen on the pump housing 30. The transition region of the first connection piece 33 to the pump housing 30 is formed by a circumferential sealing ramp 38. Said sealing ramp is integrally formed on the one hand on the sealing bead and on the other hand on the pump housing 33 in order to stabilize the detent rib 53.

Up to this point, said detent rib 53 has only been described in interaction with a securing means 5 in the form of a tamper-proof band 51 comprising corresponding stop lugs 52. The same detent ribs 53 can, however, also be used to secure the metering pump 3 relative to the second connection piece 4. In a preferred embodiment, the second connection piece 4 has a collar 47 at the end of the connecting tube section 43 which is opposite the flange 41 and a plurality of axially extending ribs 48 between said collar 47 and the flange 41. Said ribs 48 hold the collar 47 in a deformation resistant manner relative to the flange 41. Counter securing means, which engage with the detent ribs 53 on the pump housing 30 as soon as the metering pump 3 is completely screwed into the second connection piece 4, are now mounted to the collar 47 on the side thereof facing away from the flange 41. In the simplest form, at least one detent notch 56 could be provided directly in an upper ramp region of the connecting tube section 43 of the second connection piece 4. In the present case, two detent notches 56 are placed in the region of the collar 47. Said detent notches 56 are formed by two detent ramps 57 which are integrally formed on the collar 47 and extend in opposite directions. This is particularly evident and well illustrated in the enlarged section in FIG. 9.

The device (1) according to the invention for the metered dispensing of a fluid from a tubular bag 2 not only guarantees an aseptic delivery of the packaged goods and an absolute hygienic opening of the tubular bag, but has, thanks to the double seal, at least approximately a practically gastight sealing of the tubular bag by means of the device according to the invention. To this end, there is a first seal, as already mentioned above and described, between the first connection piece 33 and the second connection piece 4. The connecting tube section 43 thus has on the inner face thereof a first sealing lip or sealing bead 46 which is integrally formed in the free region of the connecting tube section 43 beneath the conical wall 45. This is shown in FIGS. 10 and 11. In FIG. 11, the second sealing region can, however, also be seen, which forms a seal between the second connection piece 4 and the pump housing 30. Said sealing region is depicted in FIGS. 12*a* and 12*b* in an enlarged scale. In these figures, a portion of the connecting tube section 43 can be seen in the region in which said section merges into the collar 47. The internal thread 44 can be seen in the connecting tube section 43. A sealing annular wall 49 which protrudes vertically upwards is located directly above the wall of the connecting tube section 43 of the second connection piece 4 and aligns with the same. The wall of the collar 47 of the second connection piece 4 has an annular recess 40 which ensures a flexible free position of the sealing annular wall 49. A circumferential sealing head 49' is integrally formed on the upper, free end of said annular wall 49.

In FIG. 12*a*, a portion of the pump housing 30 can be seen which protrudes with the integrally formed first connection piece 33 thereof into the connecting tube section 43 of the second connection piece 4. A circumferential, annular sealing ramp 38, which has a ramp-like inclination, is integrally formed between the first connection piece 33 and the second pump housing 30. Said annular sealing ramp 38 rests on top of the sealing head 49' at the upper end of the sealing annular wall 49 in FIG. 12*a*. In FIG. 12*b*, the pump housing comprising the first connection piece 33 is now screwed completely into the second connection piece 4. In this situation, the detent rib 43 now lies in the detent notch 56, the boundary of which is formed by the detent ramp 57 which is visible in section in FIGS. 12*a* and 12*b*. In this situation, the sealing annular wall is now deformed by the annular sealing ramp 38 of the pump housing 31 so as to be curved inwards. As a result, the circumferential sealing head 49' of annular design bears in an absolutely sealing manner against the sealing ramp 38.

The invention claimed is:

1. A device (1) for the metered dispensing of a fluid from a tubular bag (2), characterized in that the device (1) is a metering pump (3), a suction side of which is provided with a first connection piece (33) comprising external thread (36), an end of which is provided with at least one opening means (34), and wherein the first connection piece (33) is connected in a threaded manner in a second connection piece (4) comprising internal thread and a flange, which is welded to the tubular bag, such that the first connection piece (33) cuts open the tubular bag (2) by the metering pump (3) being twisted relative to the second connection piece (4), wherein securing means (5) ensure that a correct position of the first connection piece (33) relative to the second connection piece (4) is maintained before first use, and wherein the securing means (5) are formed by a protrusion (54) in an entry area of the external thread of the first connection piece and a detent recess (55) on the internal thread (44) of the second connection piece (4), so that the cutting and/or perforating teeth (35) are situated completely within the second connection piece (4) before the first use of the opening means (34).

2. The device according to claim 1, characterized in that the metering pump (3) is a disposable pump made from plastic.

3. The device according to claim 2, characterized in that the metering pump (3) is a rotary pump.

4. The device according to claim 1, characterized in that a tamper-proof band (51) serving as the securing means (5) is integrally formed via predetermined breaking point bridges on a lower edge of the second connection piece (4), said tamper-proof band allowing the second connection piece (4) to be twisted relative to the first connection piece (33) only after said tamper-proof band has been removed.

5. The device according to claim 1, characterized in that the second connection piece (4) has a conical connecting wall (45) from the flange (41) towards the internal thread (44) of said second connection piece (4).

6. The device according to claim 5, characterized in that the opening means (34) lie completely in a conical region of the connecting wall (45) in a mounted state before first use.

7. The device according to claim 1, characterized in that at least one detent rib (53) is integrally formed on a pump housing (30) adjacent to the first connection piece (33) on an inlet side of the metering pump (3) and at least one detent recess (55) is formed on an upper edge of the second connection piece (4), in which recess the at least one detent rib (53) engages if the metering pump (3) comprising the first connection piece (33) is screwed completely into the second connection piece (4).

8. The device according to claim 7, characterized in that the second connection piece (4) has a collar (47) at an end thereof remote from the flange (41) and that a detent notch (56) is formed between two detent ramps (57) that are integrally formed on the collar and extend in opposite directions.

9. The device according to claim 1, characterized in that a first sealing lip or sealing bead (46) disposed on an inner face of connecting tube section (43) is integrally formed on the second connection piece (4) in a region in proximity of the flange and, while closely contacting an outside of the first connection piece (33), seals said first connection piece from the second connection piece (4).

10. The device according to claim 1, characterized in that a second sealing lip configured as a sealing annular wall (49) and extending around a clear opening of the second connection piece (4) is integrally formed on said second connection piece (4) at a flange-free end, said sealing annular wall bearing against a pump housing (30) when the second connection piece is completely screwed onto the first connection piece.

11. The device according to claim 10, characterized in that the pump housing (30), which extends around the first connection piece (33) on a suction side comprises an inclined sealing ramp (38), the sealing annular wall (49) bearing against the sealing ramp (38) when the first connection piece is completely screwed into the second connection piece.

12. The device according to claim 1, characterized in that a plurality of cutting and/or perforating teeth (35) serving as the opening means (34) are integrally formed on the first connection piece (33).

13. The device according to claim 8, characterized in that ribs (48) extending axially are integrally formed on the second connection piece between the flange (41) and the collar (47).

14. The device according to claim 13, characterized in that the ribs (48) protrude outwardly up to maximally an outer edge of the collar (47).

15. A device (1) for the metered dispensing of a fluid from a tubular bag (2), characterized in that the device (1) is a metering pump (3), a suction side of which is provided with a first connection piece (33) comprising external thread (36), an end of which is provided with at least one opening means (34), and wherein the first connection piece (33) is connected in a threaded manner in a second connection piece (4) comprising internal thread and a flange, which is welded to the tubular bag, such that the first connection piece (33) cuts open the tubular bag (2) by the metering pump (3) being twisted relative to the second connection piece (4), wherein at least one detent rib (53) is integrally formed on a pump housing (30) adjacent to the first connection piece (33) on an inlet side of the metering pump (3) and at least one detent recess (55) is formed on an upper edge of the second connection piece (4), in which recess the at least one detent rib (53) engages if the metering pump (3) comprising the first connection piece (33) is screwed completely into the second connection piece (4).

16. The device according to claim 15, characterized in that the second connection piece (4) has a collar (47) at an end thereof remote from the flange (41) and that a detent notch (56) is formed between two detent ramps (57) that are integrally formed on the collar and extend in opposite directions.

17. A device (1) for the metered dispensing of a fluid from a tubular bag (2), characterized in that the device (1) is a metering pump (3), a suction side of which is provided with a first connection piece (33) comprising external thread (36), an end of which is provided with at least one opening means (34), and wherein the first connection piece (33) is connected in a threaded manner in a second connection piece (4) comprising internal thread and a flange, which is welded to the tubular bag, such that the first connection piece (33) cuts open the tubular bag (2) by the metering pump (3) being twisted relative to the second connection piece (4), wherein a second sealing lip configured as a sealing annular wall (49) and extending around a clear opening of the second connection piece (4) is integrally formed on said second connection piece (4) at a flange-free end, said sealing annular wall bearing against a pump housing (30) when the second connection piece is completely screwed onto the first connection piece.

18. The device according to claim 17, characterized in that the pump housing (30), which extends around the first connection piece (33) on a suction side comprises an inclined sealing ramp (38), the sealing annular wall (49) bearing against the sealing ramp (38) when the first connection piece is completely screwed into the second connection piece.

* * * * *